US005245994A

United States Patent [19]

Chang et al.

[11] Patent Number: 5,245,994

[45] Date of Patent: Sep. 21, 1993

[54] AIR CLEANING AND SUPPLYING SYSTEM EQUIPPED TO A HELMET FOR A MOTORCYCLIST

[75] Inventors: Li-Tung Chang; Maw-Chang Lee, both of Taipei, Taiwan

[73] Assignee: National Science Council, Taiwan

[21] Appl. No.: 763,643

[22] Filed: Sep. 23, 1991

Related U.S. Application Data

[63] Continuation-in-part of Ser. No. 638,819, Jan. 8, 1991, abandoned.

[51] Int. Cl.[5] ..... A42C 5/04; A42B 3/28; A62B 7/00

[52] U.S. Cl. ..... 128/201.25; 128/205.12; 128/206.12; 128/201.23; 2/171.3; 2/173

[58] Field of Search ..... 128/200.24, 201.15, 128/201.25, 204.18, 205.12, 205.25, 205.29, 206.12, 206.27, 206.28, 206.21, 201.22, 201.23; 2/171.3, 173, 6

[56] References Cited

U.S. PATENT DOCUMENTS

| | | | |
|---|---|---|---|
| 3,079,917 | 3/1963 | Pate | 128/206.27 |
| 3,234,939 | 2/1966 | Morton | 128/206.27 |
| 4,328,798 | 5/1982 | Isaacson | 128/202.27 |
| 4,498,202 | 2/1985 | Yamamoto | 2/424 |
| 4,502,480 | 3/1985 | Yamamoto | 128/201.15 |
| 4,590,951 | 5/1986 | O'Connor | 128/204.23 |
| 4,700,411 | 10/1987 | Kawasaki | 2/425 |
| 4,852,564 | 8/1989 | Sheridan | 128/202.27 |
| 4,903,694 | 2/1990 | Hager | 128/204.15 |
| 5,093,938 | 3/1992 | Kamata | 2/424 |
| 5,136,728 | 8/1992 | Kamata | 2/424 |

FOREIGN PATENT DOCUMENTS

| | | |
|---|---|---|
| 339487 | 11/1989 | European Pat. Off. . |
| 3204932 | 8/1983 | Fed. Rep. of Germany . |
| 9002582 | 3/1990 | World Int. Prop. O. . |

*Primary Examiner*—Edgar S. Burr
*Assistant Examiner*—Eric P. Raciti
*Attorney, Agent, or Firm*—Michael D. Bednarek

[57] ABSTRACT

An air cleaning and supplying system is provided to a helmet for a user riding a motorcycle. The air cleaning and supplying system is capable of providing cleaned air and supplies the same to the helmet for ventilating the air inside the helmet as well as for the motorcyclist to breathe the cleaned air when the motorcyclist is riding in a hot and air-polluted atmosphere. A blower coupled with a filter utilizes the power from the engine of the motorcycle for sucking air from the atmosphere. The filter is capable of filtering out pollutant gaseous particles from the air passing therethrough. An air hose connected between the helmet and the blower is used for conducting the cleaned air from the blower to the helmet. The cleaned air thus received by the helmet is separated into two parts: one part is sent into the helmet and used for circulating the air inside the helmet, and the other part is sent to a mouthpiece for the user to breathe.

12 Claims, 14 Drawing Sheets

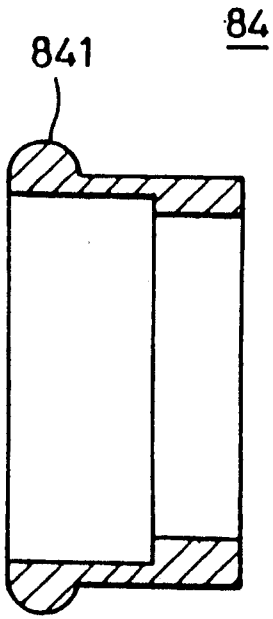
FIG. 7B II
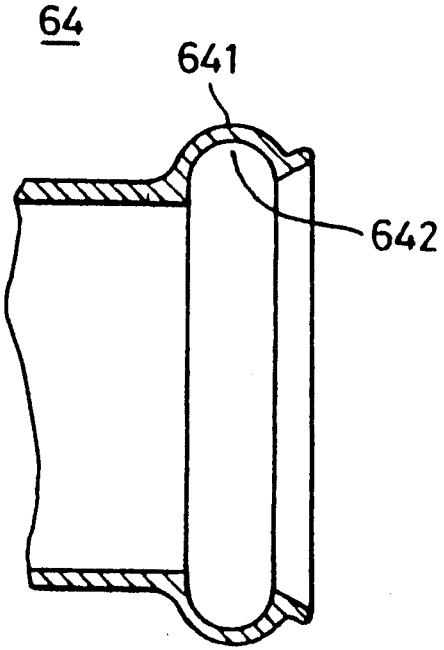
FIG. 7B I

AIR CLEANING AND SUPPLYING SYSTEM EQUIPPED TO A HELMET FOR A MOTORCYCLIST

CROSS-REFERENCE TO RELATED APPLICATIONS

This application continuation-in-part (CIP) of applicant's U.S. application entitled "Cooling and Air-Cleaning System for the Motorcycle Helmet" filed Jan. 8, 1991 under Ser. No. 07/638,819 now abandoned.

BACKGROUND OF THE INVENTION

The present invention relates generally to an air cleaning and supplying system equipped to a helmet for a motorcyclist. In particular, the air cleaning and supplying system provides clean air and supplies the same to the helmet for ventilating the air inside the helmet as well as for the motorcyclist to breathe the cleaned air when the motorcyclist is riding in a hot and air-polluted atmosphere.

Motorcyclists riding in a large crowded city have been long plagued by the exhausted gas exhaled from other vehicles riding on the same street. The case is even worse when a motorcyclist is riding on a hot day wearing a helmet. In this case, the motorcyclist suffers not only from the air pollution but also from the suffocating and sultry air inside the helmet. Up to the present time, no suggestions or teachings, perhaps except altering to ride in an air conditioned automobile, have been proposed to solve these problems. However, this is somewhat impractical for a city in which the motorcycle is a main transportation means for most of the residents.

SUMMARY OF THE INVENTION

It is therefore a primary object of the present invention to provide an air cleaning and supplying system which is capable of providing cleaned air for a motorcyclist to breathe when the motorcyclist is riding in a hot and air-polluted environment.

It is another object of the present invention to provide an air cleaning and supplying system which is capable of providing breezing air inside the helmet worn by a motorcyclist.

In accordance with the above objects, there is provided an air cleaning and supplying system equipped to a helmet for a motorcyclist riding a motorcycle. The air cleaning and supplying system is capable of providing cleaned air and supplies the same to the helmet for ventilating the air inside the helmet as well as for the motorcyclist to breathe the cleaned air when the motorcyclist is riding in a sultry and air-polluted environment.

A blower coupled with a filter utilizes the power from the engine of the motorcycle for sucking air from the atmosphere. The filter is capable of filtering out pollutant gaseous particles from the sucked air passing therethrough.

An air hose connected between the helmet and the blower is used for conducting the cleaned air from the blower to the helmet. The cleaned air thus received by the helmet is separated into two parts: one part is sent into the interior of the helmet and used for circulating the air inside the helmet; and the other part is sent to a mouthpiece for the user to breathe.

BRIEF DESCRIPTION OF THE DRAWINGS

The present invention can be more fully understood by reference to the following detailed description of the preferred embodiments with references made to the accompanying figures, wherein:

FIG. 7B shows the longitudinal sectional view of the connectors of FIG. 7A;

DETAILED DESCRIPTION OF THE PREFERRED EMBODIMENTS

Figure 1:
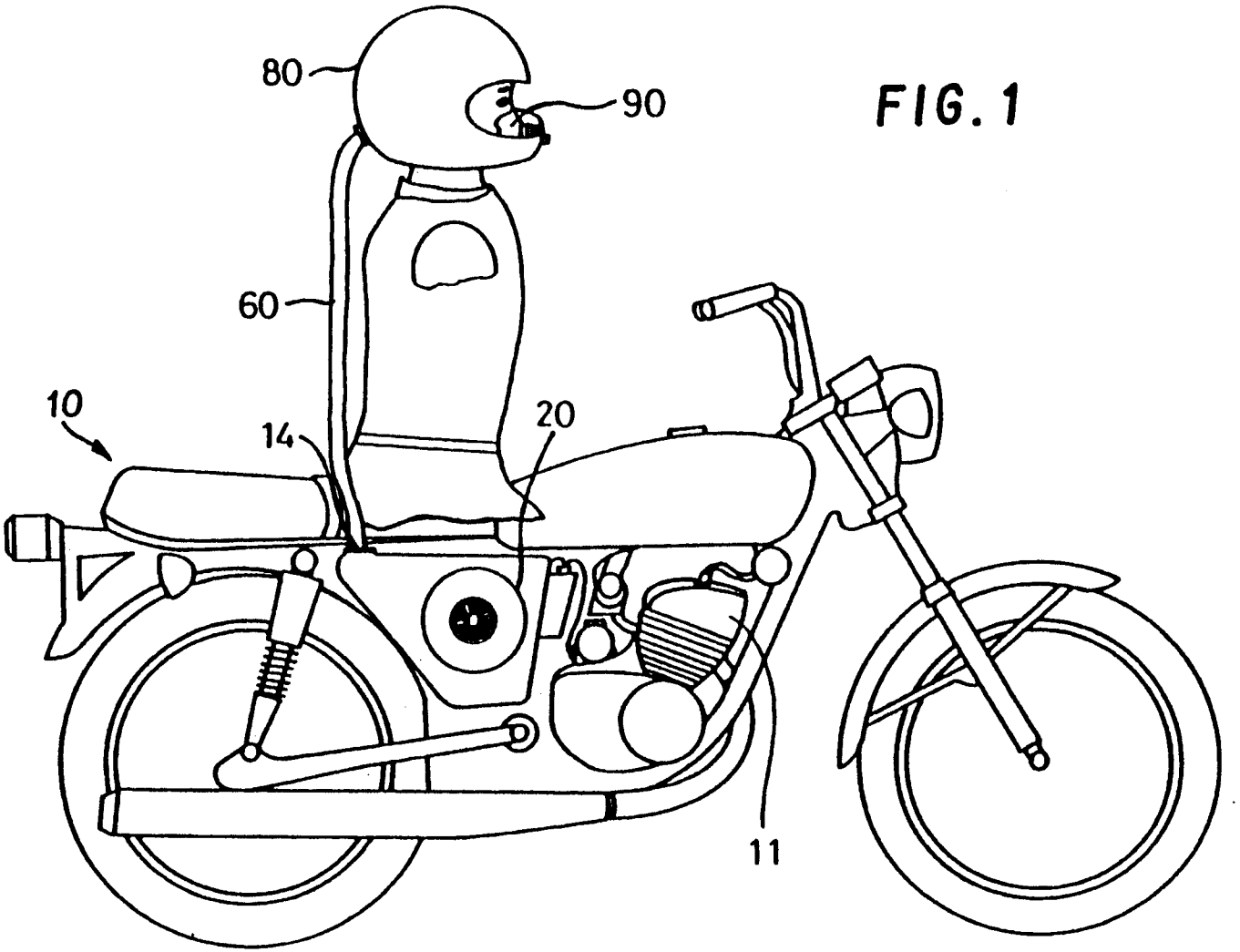
FIG. 1 is an illustration of a motorcyclist riding a motorcycle and wearing a helmet equipped with an air cleaning and supplying system according to the present invention.
Figure 2:
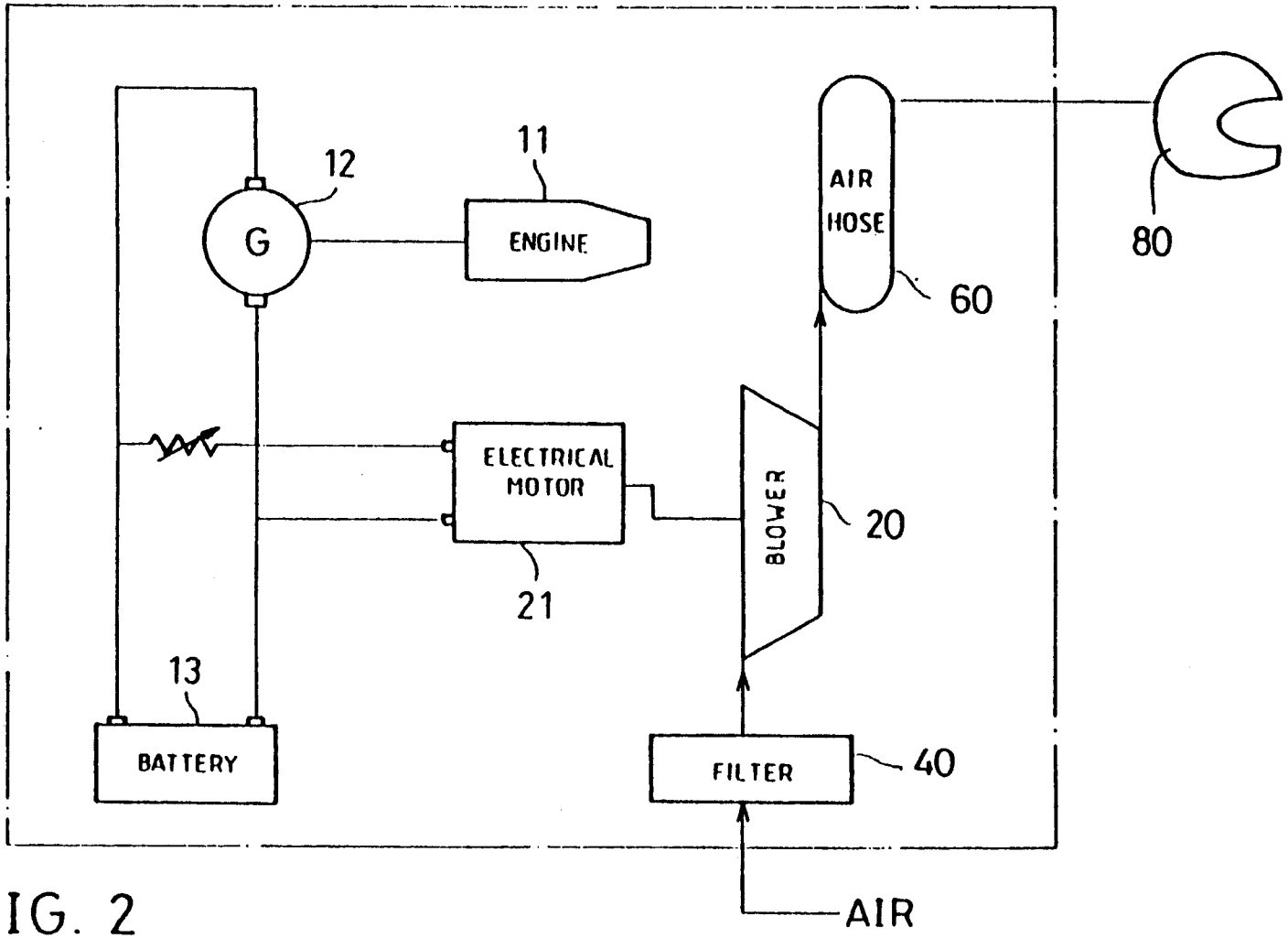
FIG. 2 is a schematic block diagram, showing an air cleaning and supplying system according to a preferred embodiment of the present invention.

The configuration of an air cleaning and supplying system according to the present invention is illustrated in FIGS. 1 and 2. Referring to FIG. 1, there is shown a motorcyclist riding a motorcycle 10 and wearing a helmet 80 equipped with the air cleaning and supplying system of the present invention. The air cleaning and supplying system is capable of supplying cleaned air via an air hose 60 to the helmet 80. The air hose 60 is normally housed in a blower 20 disposed within the frame of the motorcycle 10 When in use, the motorcyclist can pull the air hose 60 out of the blower 20 from an opening 14 of the frame of the motorcycle and engage the air hose 60 to the helmet 80.

Referring to FIG. 2, the blower 20 is utilized for sucking air from the environmental atmosphere. The sucked air will pass through a filter 40 before entering into the blower 20. The filter 40 is capable of absorbing dust and pollutant gaseous particles contained in the sucked air, thereby cleaning the sucked air. The cleaned air is then blown by the blower 20 via the air hose 60 into the helmet 80 worn by the motorcyclist.

Upon entering into the helmet 80, the cleaned air is separated into two parts: one part will used for ventilating the air inside the helmet 80, and the other part will be direct to a mouthpiece 90 attached to the face of the motorcyclist for the motorcyclist to breathe. The provisions inside the helmet 80 will be described in more detail later in this description section.

It is an important aspect of the present invention to utilize the power from the motorcycle engine 11 for driving the blower 20. Two methods can be utilized to transfer power from the engine of the motorcycle 10 to the blower 20, i.e. a direct transmission method or an indirect transmission method.

The direct transmission method (not shown in the drawings) utilizes a shaft which is driven directly by the engine of the motorcycle 10. The rotation of the shaft would then drive the blower 20. Since the direct transmission method requires modifications to the engine of the motorcycle 10 to incorporate the additional shaft, the indirect transmission method therefore will not utilized in the preferred embodiment of the present invention.

Figure 3:
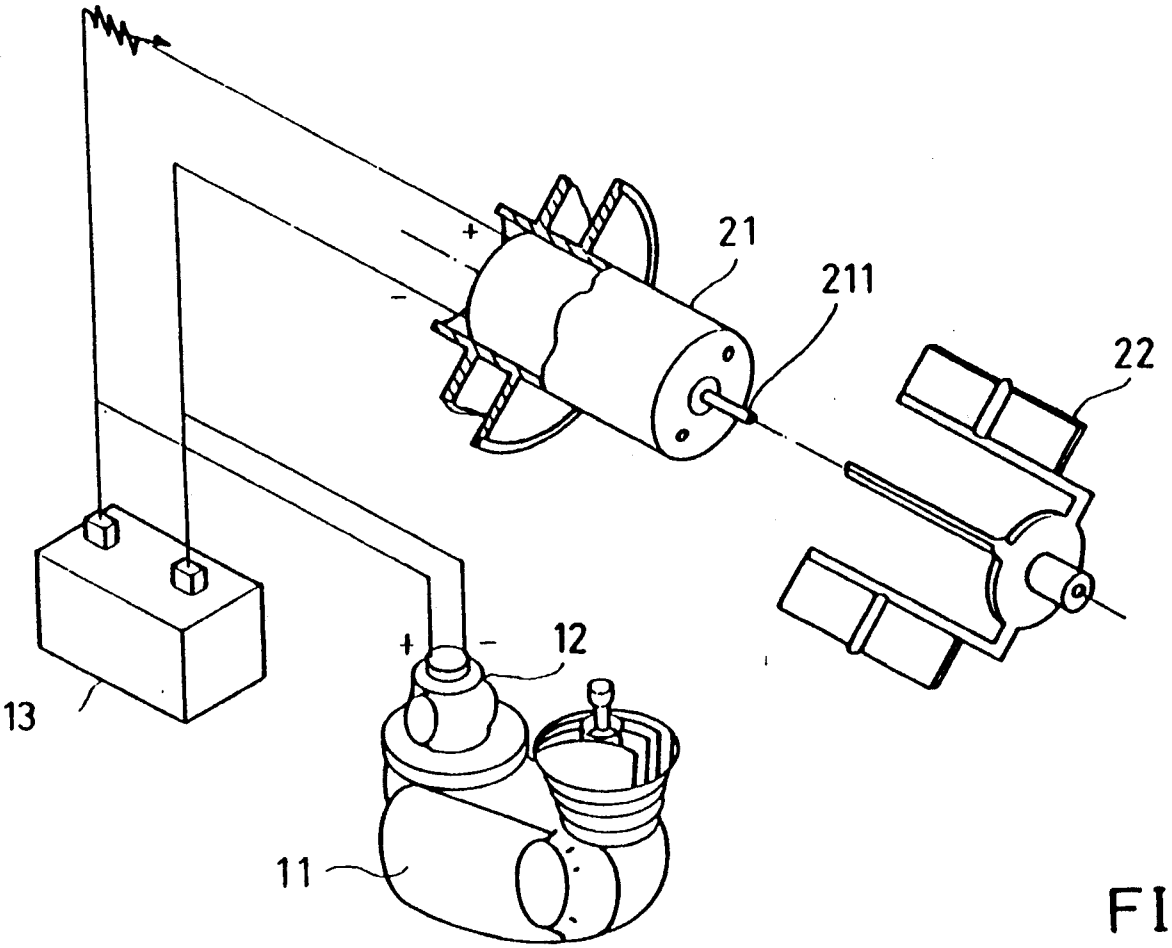
FIG. 3 illustrates the indirect transmission method utilized in the preferred embodiment of the present invention.

Referring to FIGS. 2 and 3, the indirect transmission method utilizes an electric motor 21 for driving the blower 20. The blower has a propeller 22 which is coupled to the shaft 211 of the electric motor 21. The electric motor 21 is coupled to an electric generator 12 which is a built-in part of the motorcycle 10 and driven by the engine 11 of the motorcycle 10. A rechargeable battery 13 is connected to the electric generator 12. The electric generator 12 will generate electricity when the engine 11 is running. As a result, the electric motor 21 will be driven to rotate the propeller 22 of the blower 20 when the engine is running.

Consequently, as the motorcycle 10 is riding, the engine 11 thereof will drive the blower 20 to rotate the propeller 22 such that air in the environmental atmosphere is sucked through the filter 40 into the blower 20 and then blown via the air hose 60 to the helmet 80.

Figure 4A:
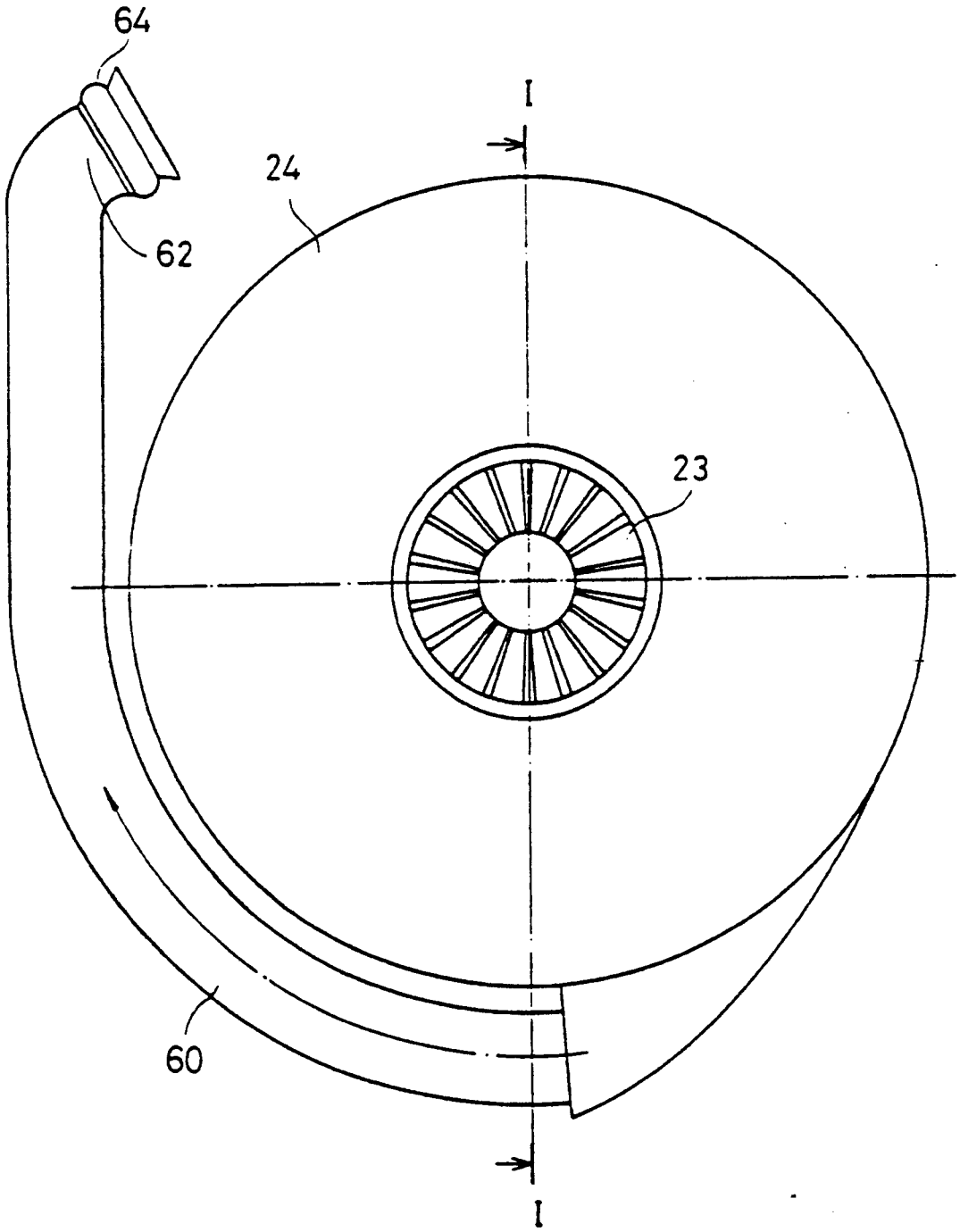
FIG. 4A is a top view of the blower.
Figure 4B:
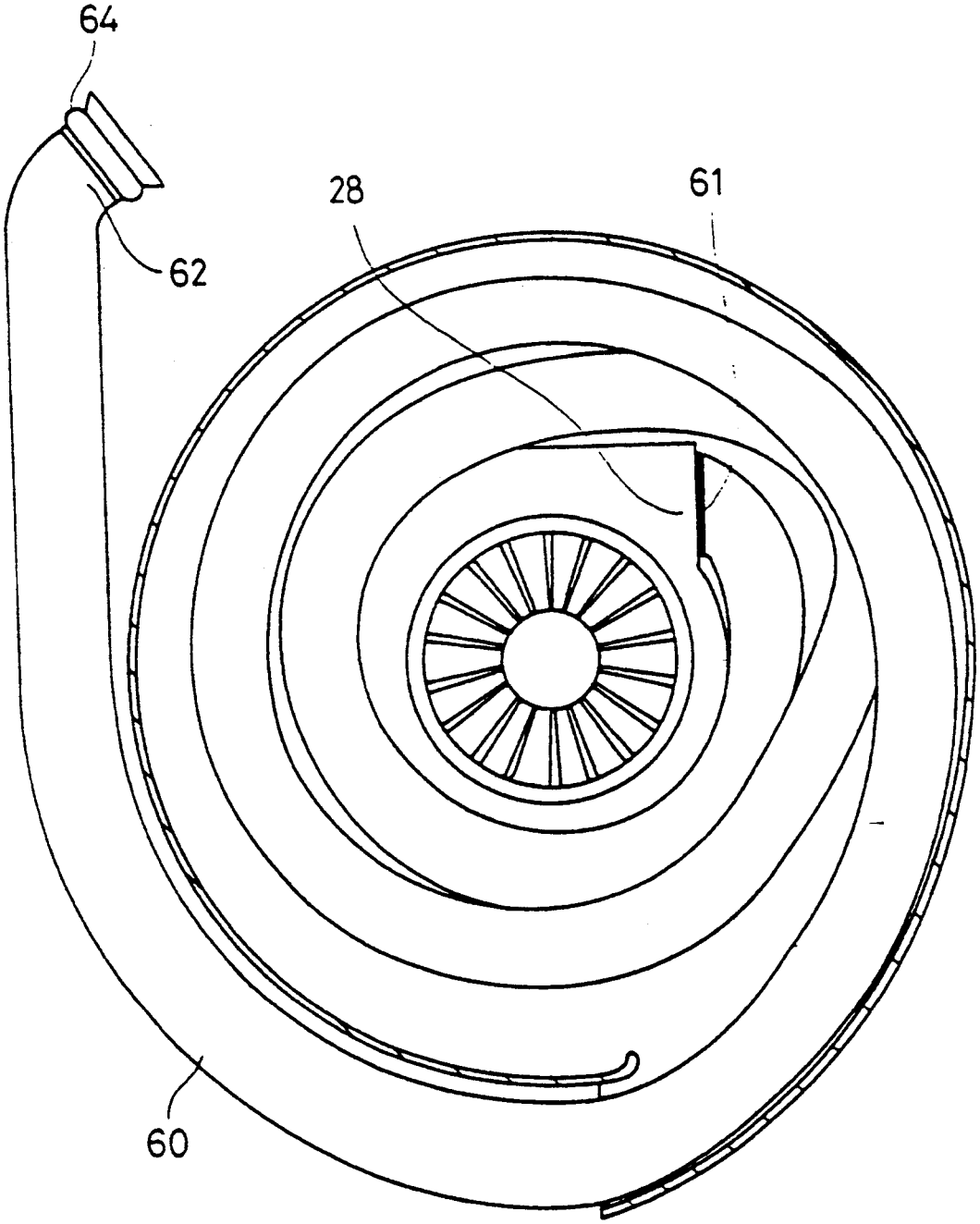
FIG. 4B is a top view of the blower with parts broken away to show an air hose housed therewithin.
Figure 5:
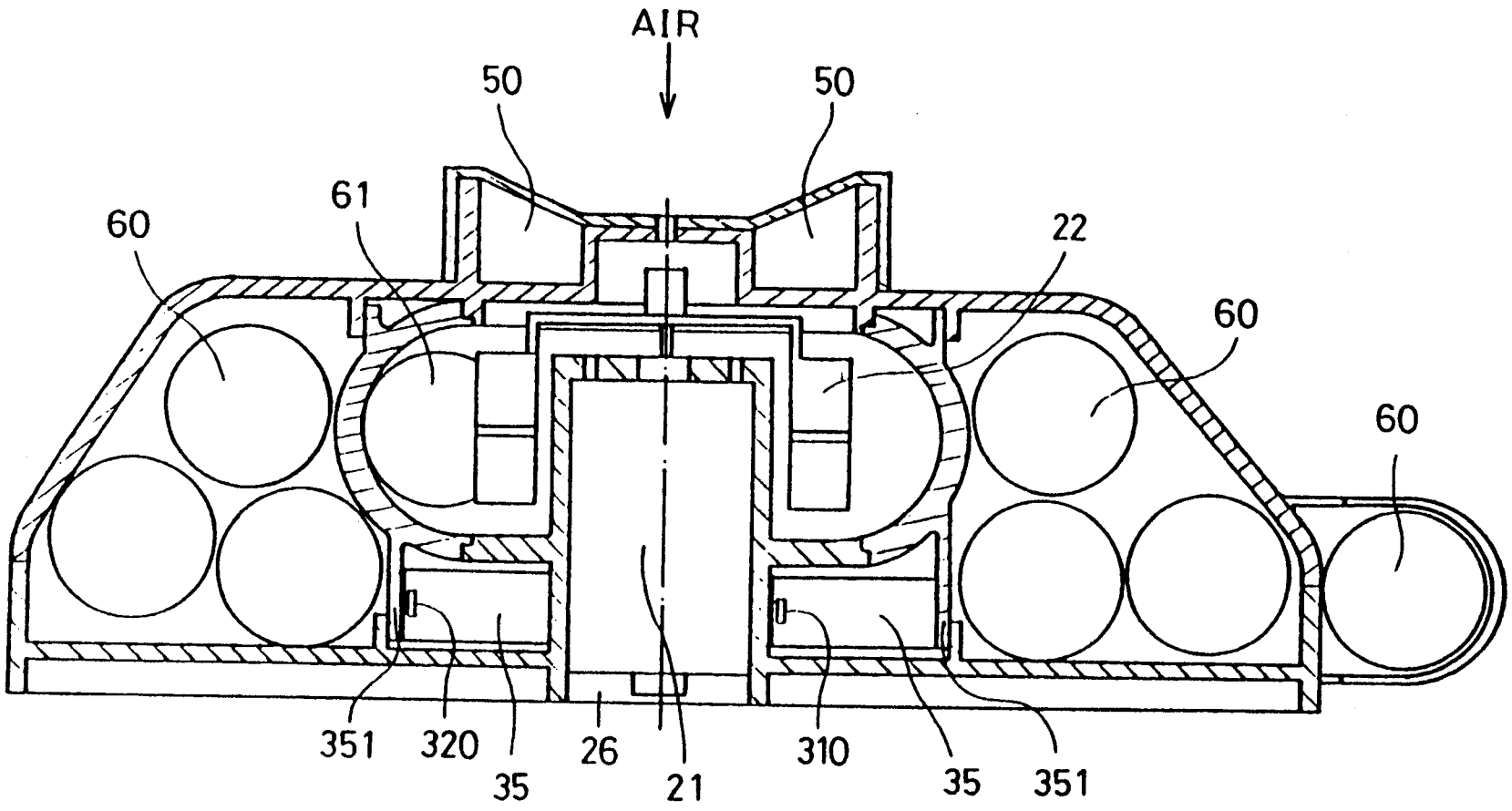
FIG. 5 is a sectional view of the blower taken along the lines I—I of FIG. 4A.

Referring to FIGS. 4–6, the blower 20 utilized in the present invention includes a circular casing 24 for housing the air hose 60, and a cylindrical compartment 26 for accommodating the electric motor 21. The air hose 60, when housed, in the circular casing 14, is wound around the cylindrical compartment 26 as shown in FIG. 5.

The cleaned air is blown out of the blower 20 from an air outlet 28 which is connected to the end 61 of the air hose 60.

Figure 6B:
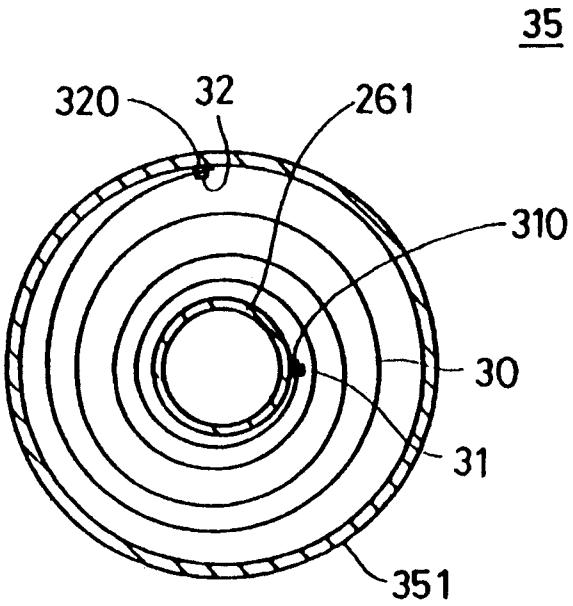
FIG. 6B shows how the spiral spring of FIG. 7 is fastened within a doughnut-like compartment of the blower.
Figure 6A:
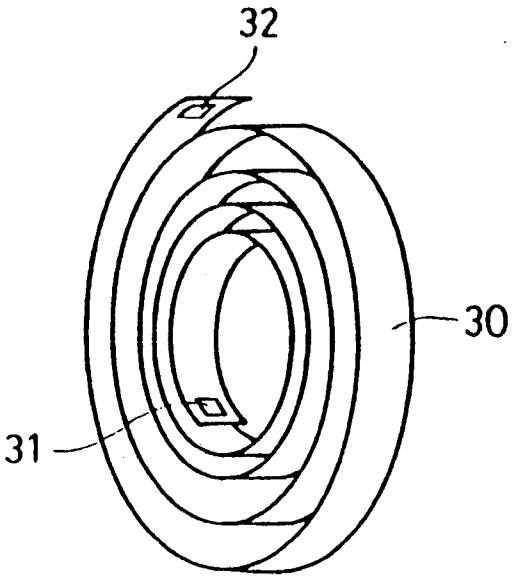
FIG. 6A shows a spiral spring.

Referring further to FIGS. 6A and 6B, the blower 20 further includes a doughnut-like compartment 35 for accommodating a spiral spring 30. The spiral spring 30 has an inner end 31 fixed to a spot 310 on the outer surface of the outer wall 261 of the cylindrical compartment 26; and an outer end 32 fixed to a spot 320 on the inner surface of the outer wall 351 of the doughnut-like compartment 35.

The outer wall 261 of the cylindrical compartment 26 is a fixed portion and acts as a bearing for supporting the rotation of the portions which encircle the cylindrical compartment.

The air hose 60 is normally housed in the circular casing 24 of the blower 20. When in use, the air hose 60 can be dragged out of the blower 20 and engaged to the helmet 80. As the air hose 60 is being dragged out of the circular casing 24 of the blower 20, the wall 351 will be rotated in the clockwise direction as shown in FIG. 6B. Since the wall 261 is a fixed portion, the spiral spring 30 will be twisted tight.

Therefore, when the air hose 60 is disengaged from the helmet 80 and released free, the wall 351 will be rotated in the counterclockwise direction due to the restoring elastic force of the spiral spring 30, thereby rewinding the air hose 60 back into the circular casing 24 of the blower 20. In this way, the air hose 60 is retractable. The retracting mechanism provided to the air hose 60 is somewhat similar to that commonly seen in retracting an electric wire back into the frame of a vacuum cleaner.

The filter 40 is a circular casing 50 contained with cotton fibers and active carbons. The circular casing 50 is attached to the inlet opening 23 of the blower 20, whereby the sucked air will pass through the filter 40 before entering into the blower 20. The cotton fibers are capable of attaching dust contained in the sucked air thereto; and the active carbons are capable of absorbing gaseous chemical substances contained in the exhausted gases of vehicles. As a result, air entering into the blower 20 is a cleaned air and which will subsequently be blown by the blower 20 via the air hose 60 to the helmet 80.

After the air hose 60 is pulled out of the blower 20, the end 62 thereof can be engaged to an inlet port 81 on the helmet 80. The mechanism of the engagement, however, should be designed to allow the motorcyclist to disengage the air hose 60 quickly from the helmet 80 so that, under an emergency situation, the action of the motorcyclist would not be hindered. Therefore, screw type engagement is not recommended to be used in the preferred embodiment of the present invention.

Figure 7A:
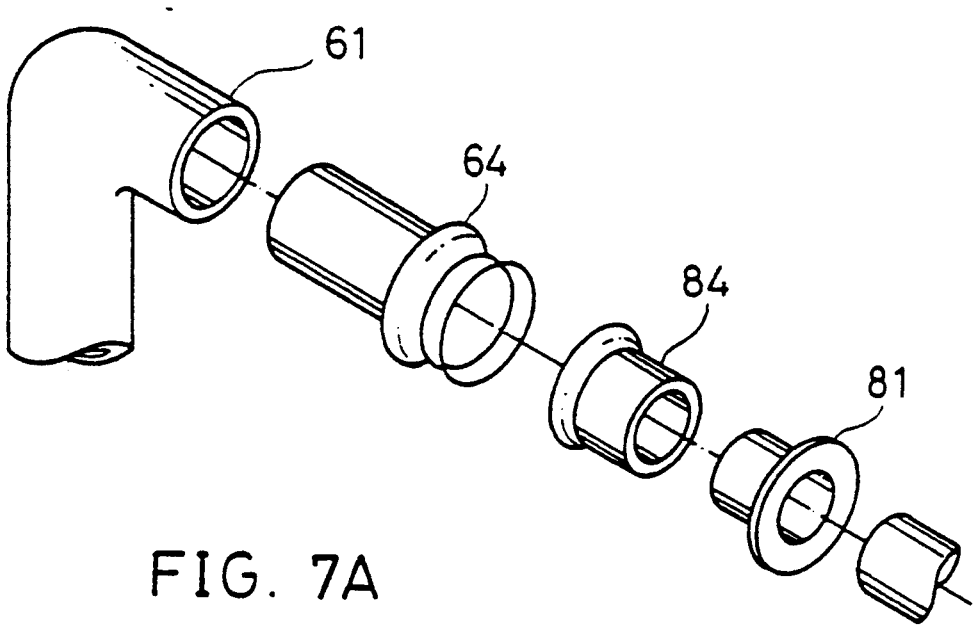
FIG. 7A shows the connectors used for engaging the air hose to a inlet port of the helmet.
Figure 7C:
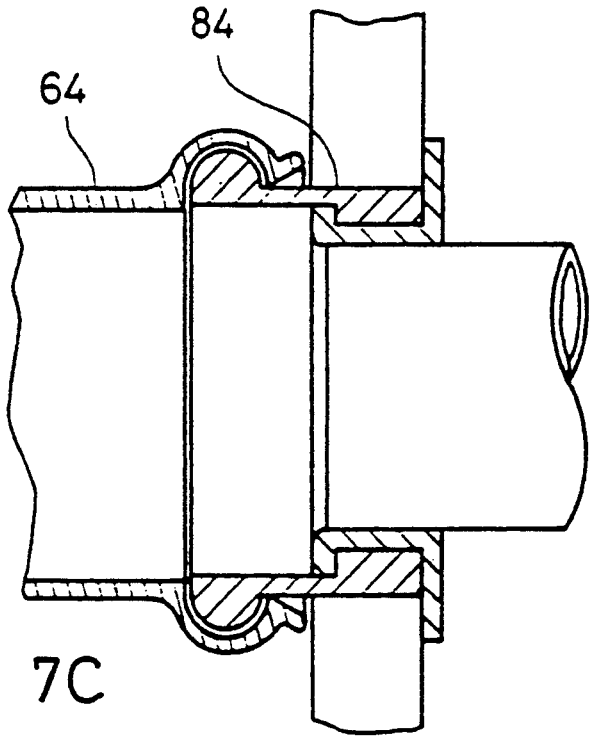
FIG. 7C also shows the longitudinal sectional view of the connectors of FIG. 7A except that the connectors are engaged.

Referring to FIGS. 7A–7C, a first connector 64 is fixed to the end 62 of the air hose 60; and a second connector 84 is fixed to the inlet port 81 on the helmet 80. The first connector 64 has a flexible head 641 with a portion arched to form a recess 642. The flexible head 641 is preferably made of The end of the second connector 84 is provided with a protrusion 841 encircling the outer circumference thereof. The protrusion 841 can be inserted into the flexible head 641 and accommodated tightly in the recess 642, thereby connecting the air hose 60 and the inlet port 81 of the helmet 80.

The engagement of the flexible head 641 with the ring protrusion 841 allows hardly any air leakage therefrom. Since the flexible head 641 is flexible, the protrusion 841 can be pulled out therefrom with a somewhat strong effort. Therefore, under an emergency situation, the motorcyclist can easily and quickly disengage the air hose 60 from the helmet 80 by simply pulling somewhat forcibly the air hose 60.

Figure 8:
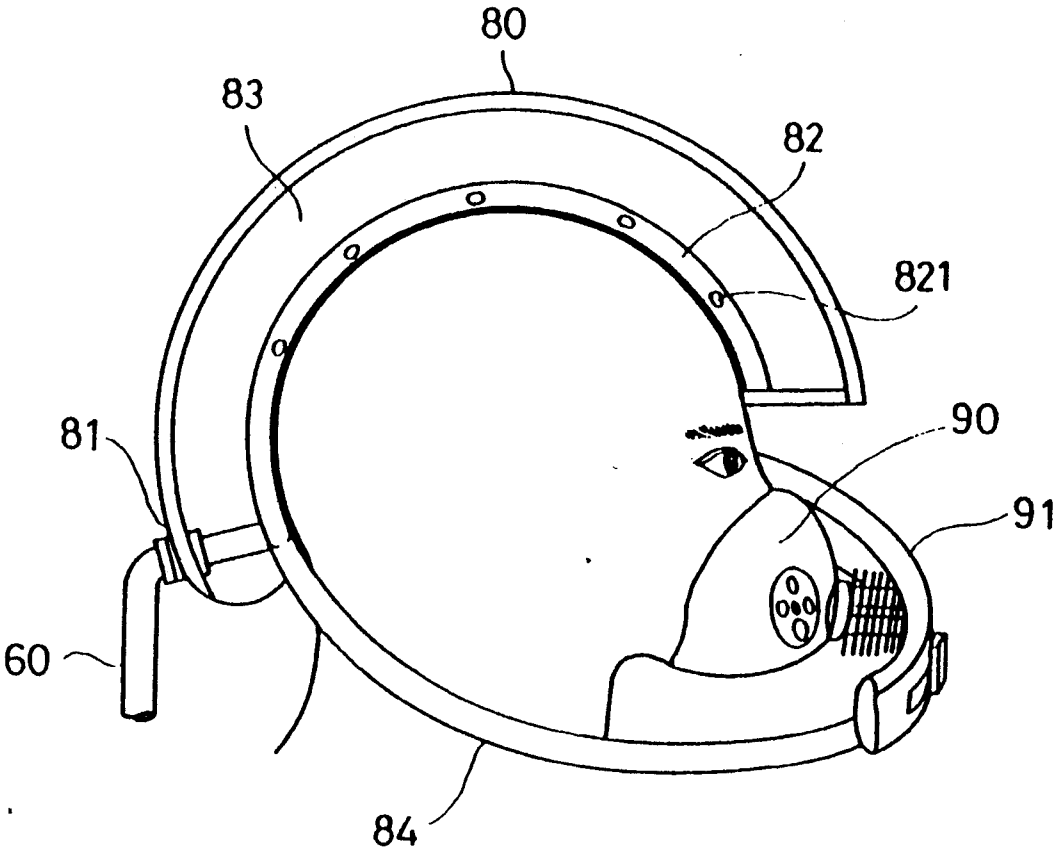
FIG. 8 is a partly sectional and partly perspective view, showing a motorcyclist wearing the helmet equipped with the present invention.
Figure 9:
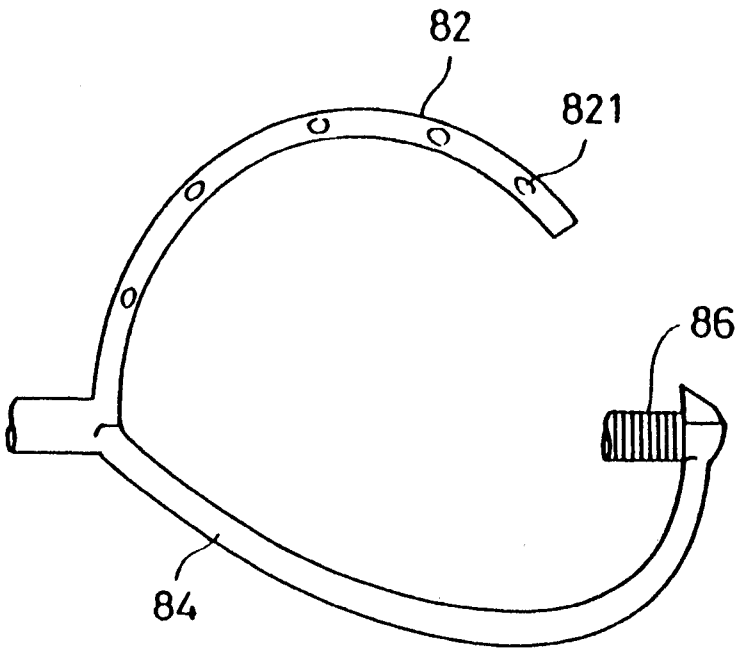
FIG. 9 shows a bifurcated air pipe provided in the helmet.
Figure 10:
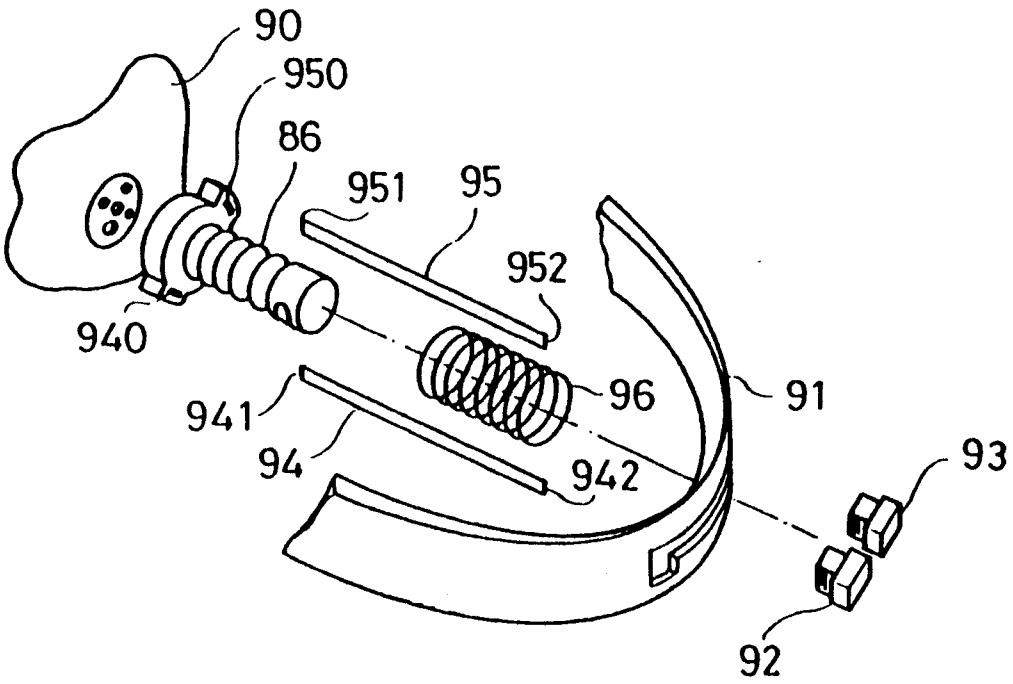
FIG. 10 shows the unassembled comprising parts of a mechanism provided to the mouthpiece for controlling the attachment and detachment of the mouthpiece.

Referring to FIGS. 8 and 9, upon entering into the helmet 80 through the inlet port 81, the cleaned air is separated into two parts by a first pipe 82 and a second air pipe 84.

The first air pipe 82 has a plurality of vent holes 821 provided through the wall thereof. The cleaned air entering the first air pipe 82 will then be discharged from the vent holes 821 into the interior of the helmet 80 such that the motorcyclist can enjoy a breeze brushing his/her head and the suffocating air inside the helmet 80 can be ventilated.

The first air tube 82 is fitted within a buffering material 83 provided at the top portion inside the helmet 80. The buffering material 83 is provided for offering a comfortable contact for the motorcyclist's head with the helmet 80. The buffering material is preferably made of polylone (expanded polystyrene).

The second air pipe 84 is utilized for conducting the other part of the cleaned air to a mouthpiece 90 arranged in front of the helmet 80. The mouthpiece 90 can be attached to the face of the motorcyclist when the motorcyclist wants to breathe the cleaned air. When not in use, the mouthpiece 90 can be detached from the face of the motorcyclist.

Referring to FIGS. 10, 11A–11B, and 12A–12B, the mouthpiece 90 is provided with an adjustment mechanism which allows the mouthpiece 90 to be attached to or detached from the face of the motorcyclist. The mechanism comprises a face mask 91, a compressible air pipe 86, a spring 96, a pair of straps 94, 95, and a pair of buttons 92, 93. The face mask 91 has a pair of L-shaped slots 97, 98 provided therethrough. The ends 941, 951 of the straps 94, 95 are fixed to the mouthpiece 90; and each of the other ends 942, 952 of the straps 94, 95 is fixed to one of the two buttons 92, 93. The compressible air pipe 86 is encircled by the spring 96 and is interconnected between the mouthpiece 90 and the second air pipe 84.

Figure 11A:
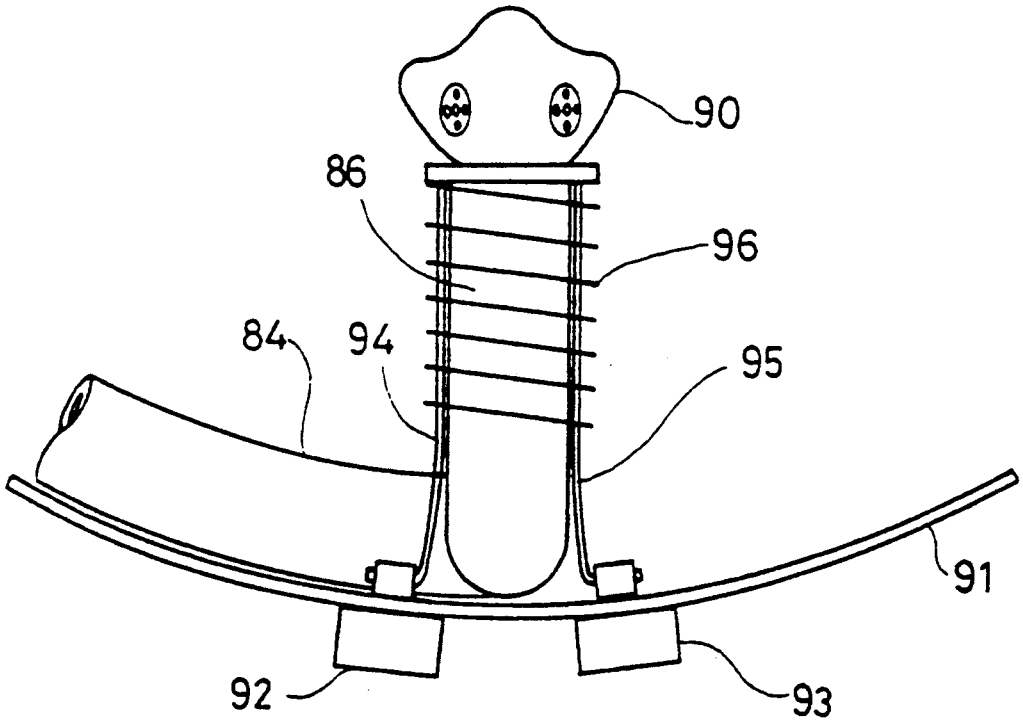
FIG. 11A is a top view of the mouthpiece with the adjust mechanism when the mouthpiece is attached to the face of the motorcyclist.
Figure 11B:
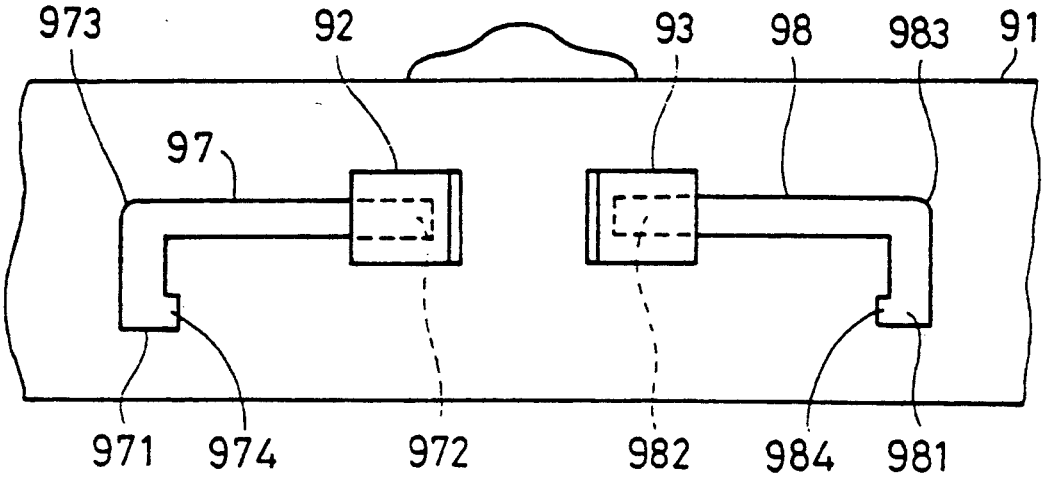
FIG. 11B is a front view of that shown in FIG. 11A, showing particularly the positions of the two buttons.

As shown in FIGS. 11A and 11B, when the mouthpiece 90 is attached to the face of the motorcyclist, the buttons 92, 93 are positioned at the ends 972, 982 of the L-shaped slots 97, 98.

Figure 12A:
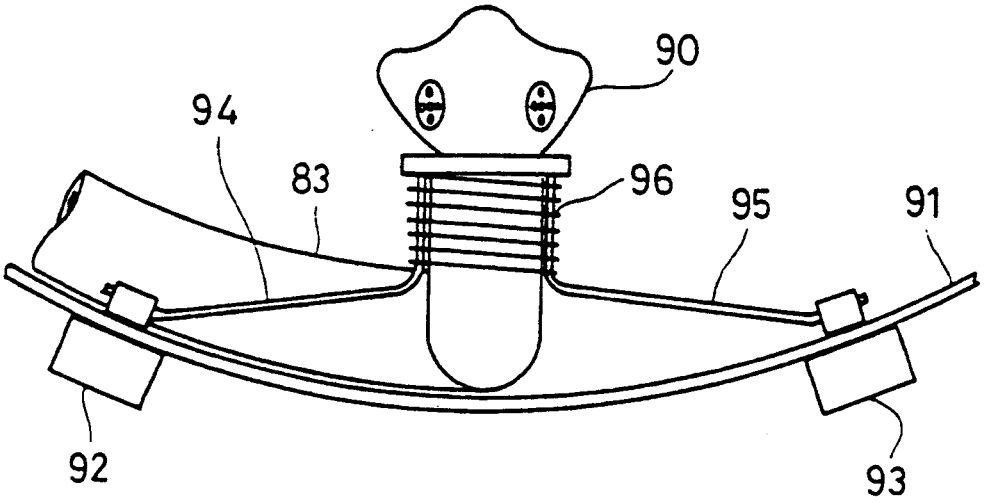
FIG. 12A shows a same view as that shown in FIG. 11A except that the mouthpiece is detached from the face of motorcyclist.
Figure 12B:
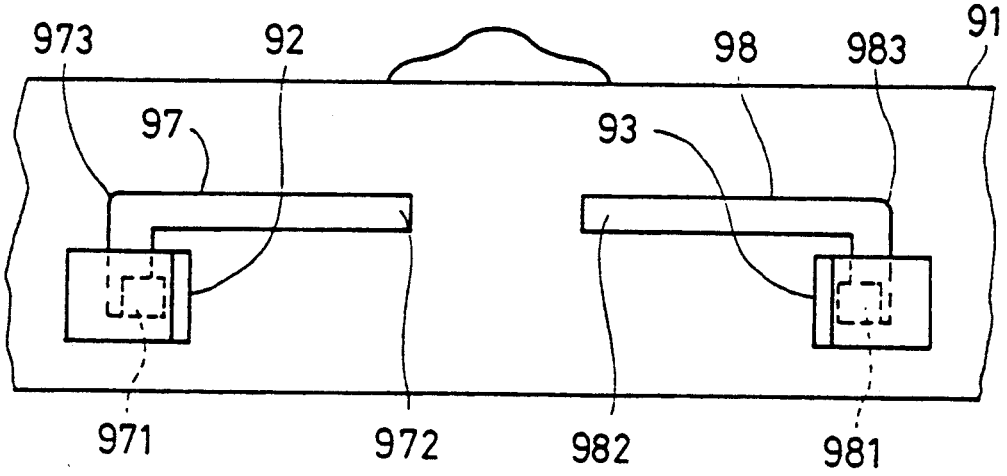
FIG. 12B is a front view of that shown in FIG. 12A, showing particularly the positions of the two buttons.

As shown in FIGS. 12A and 12B, when the motorcyclist wants to detach the mouthpiece 90 from his/her face, the motorcyclist can push the pair of buttons 92, 93 which are now positioned at the ends 972, 982 of the L-shaped slots 97, 98 outwardly to the bent portions 973, 983 and therefrom push down the same to the ends 971, 981. As a result, the mouthpiece 90 will be pulled by the straps 94, 95, which interconnect the buttons 92, 93 and the mouthpiece 90, away from the face of the motorcyclist. Since the compressible air pipe 86 is compressible, the length thereof can be shortened and the mouthpiece 90 can move close to the face mask 91.

Since each of the ends 971, 981 of the L-shaped slots 97, 98 has a slightly recessed portion 974 or 984, the buttons 92, 93 can be engaged therewithin to prevent the buttons 92, 93 from pulling back by the spring 96.

When the motorcyclist wants to use the mouthpiece 90 again, he/she can simply push the buttons 97, 98, which is now positioned at the ends 971, 981 of the L-shaped slots 97, 98, upwardly to the bent portions 973, 974. As the buttons 92, 93 have reached at the bent portions 973, 983, the compressed spring 96 is free from restrain and, as a result, the elastic force thereof will bring the mouthpiece 90 to the face of the motorcyclist, as well as bring the button 97, 98 to the ends 972, 982 of the L-shaped slots 97, 98.

Riders of motorcycles generally wear a helmet for the sake of safety. In some places wearing a helmet when riding a motorcycle is required by the law..The air cleaning and supplying system equipped to the helmet in accordance with the present invention causes no additional load for the wearer. The advantages of the present invention is obvious that a motorcyclist utilizing this system is free from the polluted and sultry air when the motorcyclist is riding in a hot and air-polluted environment.

Different structures other than those described above may be equipped to a helmet for a motorcyclist to fulfill the same objects of the present invention. Therefore, it is to be understood that the invention need not be limited to the disclosed embodiments. The spirit and scope of the present invention will be recited in the following appended claims.

What is claimed is:

1. An air cleaning and supplying system equipped to a helmet, the helmet being for a user riding a motorcycle, the motorcycle having an engine, said air cleaning and supplying system comprising:

means, powered by the engine of the motorcycle, for sucking air from the environmental atmosphere thereinto;

a filter coupled to said sucking means, for filtering out dust and pollutant gaseous particles contained in the air sucked by said sucking means;

means for introducing the cleaned air from said sucking means to helmet;

ventilating means, provided in the helmet, for introducing the cleaned air received from said sucking means into the interior of the helmet;

respiratory means, provided in the helmet, for introducing the cleaned air received from said air hose for the user to breathe, said respiratory means comprising:

a mouthpiece;

an air pipe connected between said mouthpiece and said introducing means for introducing air received from said introducing means to said mouthpiece;

means for controlling the attachment of said mouthpiece to the face of the motorcyclist and the detachment of said mouthpiece from the face of the motorcyclist, said controlling means comprising:

a face mask having a pair of L-shaped slots;

a pair of buttons capable of sliding along the L-shaped slots;

a pair of straps, each of which has one end fixed to said mouthpiece and the other end fixed to one of the buttons;

a compressible air pipe connecting said mouthpiece to said introducing means; and a spring encircling said compressible air pipe;

wherein the movement of said pair of buttons is capable of controlling the attachment and detachment of said mouthpiece.

2. An air cleaning and supplying system according to claim 1, wherein said sucking means is a blower.

3. An air cleaning and supplying system according to claim 2, wherein said blower is driven by an electrical motor which is powered by the electricity produced when the engine of the motorcycle is running.

4. An air cleaning and supplying system according to claim 2, wherein said introducing means is an air hose and which is capable of being retracted into the casing of said blower and housed therein when not in use.

5. An air cleaning and supplying system according to claim 4, wherein a first connector is provided at an end of the air hose for engaging with a second connector provided on the helmet; si first connector having a flexible head with an arched portion, the arched portion forming a recess; said second connector having a protrusion provided around the circumference thereof; whereby said first connector is capable of engaging with said second connector by inserting the protrusion of said second connector into the recess of the first connector.

6. An air cleaning and supplying system according to claim 1, wherein said filter is a casing contained with cotton fibers and active carbons.

7. An air cleaning and supplying system according to claim 1, wherein said ventilating means comprising:

an air pipe having one end connected to said air hose and a wall, a plurality of vent holes provided through the wall thereof for introducing air received from the air hose into the interior of said helmet.

8. An air cleaning and supplying system equipped to a helmet, and helmet being for a user riding a motorcycle, the helmet having a top portion provided with buffering material and a front portion through which the user may see, and the motorcycle having an engine, said air cleaning and supplying system comprising:

a blower powered by the engine of the motorcycle for sucking air from the environmental atmosphere thereinto, the blower including a propeller rotatably secured to a shaft that is powered by the engine and a casing;

a filter coupled to the blower for filtering out dust and pollutant gaseous particles contained in the air sucked by the blower;

an air hose housed within the casing, the air hose being retractable from the casing, the air hose having a first end proximate the blower and a second end provided with a first connector for engaging with a second connector provided on the helmet to allow introducing of clean air from the blower to the helmet;

a first air pipe provided in the helmet, the first air pipe having a wall and first and second ends, the first end being connected to said air hose and a plurality of vent holes provided through the wall thereof for introducing air received from the air hose into the top portion of the helmet;

a mouthpiece provided proximate the front portion of the helmet, and a second air pipe connected between said mouthpiece and the air hose for introducing air received from said air hose to said mouthpiece whereby cleaned air is separated into two parts, the first part flowing through the first air pipe for ventilating air inside the helmet and the second part flowing into the mouthpiece;

a face mask having a pair of L-shaped slots;

a pair of buttons capable of sliding along the L-shaped slots;

a pair of straps, each of which has one end fixed to said mouthpiece and the other end fixed to one of the buttons;

a compressible air pipe connecting said mouthpiece to said introducing means; and a spring encircling said compressible air pipe;

wherein the movement of said pair of buttons is capable of controlling the attachment and detachment of said mouthpiece.

9. An air cleaning and supplying system according to claim 8, wherein said blower is driven by an electrical motor which is powered by the electricity produced when the engine of the motorcycle is running.

10. An air cleaning and supplying system according to claim 8, wherein said filter is a casing contained with cotton fibers and active carbons.

11. An air cleaning and supplying system according to claim 8, wherein said first connector comprises a flexible head with an arched portion, the arched portion forming a recess; said second connector comprising the protrusion provided around the circumference thereof; and whereby said first connector is capable of engaging with said second connector by inserting the protrusion of said second connector into the recess of the first connector.

12. An air cleaning and supplying system according to claim 8, wherein the blower further comprises a spring which biases the air hose into the casing.

* * * * *